US007338564B2

(12) United States Patent
Garner et al.

(10) Patent No.: US 7,338,564 B2
(45) Date of Patent: Mar. 4, 2008

(54) POWDERED EVAPORATOR COIL CLEANER

(75) Inventors: Scott Garner, Ballwin, MO (US); Joseph Raible, St. Louis, MO (US)

(73) Assignee: Garman Company, Inc., Valley Park, MO (US)

( * ) Notice: Subject to any disclaimer, the term of this patent is extended or adjusted under 35 U.S.C. 154(b) by 0 days.

(21) Appl. No.: 11/562,787

(22) Filed: Nov. 22, 2006

(65) Prior Publication Data

US 2007/0287650 A1 Dec. 13, 2007

Related U.S. Application Data

(63) Continuation-in-part of application No. 11/292,667, filed on Dec. 2, 2005.

(60) Provisional application No. 60/811,493, filed on Jun. 7, 2006.

(51) Int. Cl.
*C11D 7/18* (2006.01)

(52) U.S. Cl. ..... 134/14; 510/184; 510/367; 510/375; 510/378; 134/22.11; 134/22.14; 165/95; 62/303

(58) Field of Classification Search ..... 510/184, 510/367, 375, 378; 134/14, 22.11, 22.14; 165/95; 62/303
See application file for complete search history.

(56) References Cited

U.S. PATENT DOCUMENTS

| | | | | |
|---|---|---|---|---|
| 2,443,766 | A | | 6/1948 | Hedberg et al. |
| 2,638,180 | A | | 5/1953 | Herkimer |
| 3,664,961 | A | * | 5/1972 | Norris ..... 510/305 |
| 3,676,352 | A | * | 7/1972 | Grimm et al. ..... 510/374 |
| 4,088,596 | A | * | 5/1978 | Arai et al. ..... 134/2 |
| 4,215,990 | A | * | 8/1980 | Barrett et al. ..... 8/107 |
| 4,678,594 | A | * | 7/1987 | Parfomak et al. ..... 252/186.31 |
| 5,208,369 | A | * | 5/1993 | Crump et al. ..... 562/106 |
| 5,698,186 | A | | 12/1997 | Weeks |
| 5,906,811 | A | | 5/1999 | Hersh |
| 5,955,412 | A | | 9/1999 | Post et al. |
| 6,162,304 | A | | 12/2000 | Weidman et al. |
| 6,403,540 | B1 | | 6/2002 | Richardson et al. |
| 6,685,916 | B1 | | 2/2004 | Holme et al. |
| 6,762,161 | B2 | | 7/2004 | Sava et al. |

OTHER PUBLICATIONS

Material Safety Data Sheet, Instant Powder Kegs™, Feb. 13, 2002, http://www.cleanac.com/Images/DataSheet/Kegs1.gif, pp. 1-2, Sections manufactured by: Controlled Release Technologies Inc., Clearwater,Florida, United States of America.

Material Safety Data Sheet, Ev Coil Max ®, http://www.highsidechem.com/coilmax.html Dec. 31, 2003, Highside Chemicals Inc., Gulfport, Mississippi, United States of America.

* cited by examiner

*Primary Examiner*—Charles Boyer
(74) *Attorney, Agent, or Firm*—Senniger Powers

(57) ABSTRACT

A prepackaged, peroxide-based, cleaning composition is described which is suitable for on-site dilution, and for cleaning substrates such as air conditioner coils.

17 Claims, No Drawings

POWDERED EVAPORATOR COIL CLEANER

REFERENCE TO RELATED APPLICATIONS

This application is a Continuation-In-Part patent application of Nonprovisional patent application Ser. No. 11/292,667 filed Dec. 2, 2005 and claims the benefit of Provisional Patent Application Ser. No. 60/811,493, filed Jun. 7, 2006, the entire contents of which are incorporated herein by reference.

FIELD OF THE INVENTION

The present invention relates generally to cleaning compositions or formulations used to clean substrates such as air conditioning coils, electronic air filters and other types of metal filters.

BACKGROUND OF THE INVENTION

Historically, cleaners used to clean air conditioning coils, electronic air filters and other types of metal filters have been sold in fairly concentrated liquid form, typically in 1 gallon, 5 gallon and 55 gallon containers. The servicemen would mix the product with water (typically 2 or 3 parts water to one part cleaner) in a 1, 2, or 3 gallon pump sprayer, then spray the diluted product onto the surface that needed to be cleaned.

Typically, three types of cleaners are used-acid coil cleaners, non-acid coil cleaners and evaporator coil cleaners. Acid coil cleaners include hydrofluoric acid as the active ingredient and are used on condenser coils located outdoors. Non-acid coil cleaners include either sodium hydroxide, potassium hydroxide or a combination of the two as the active ingredient and can be used on both condenser and evaporator coils. Evaporator coil cleaners are typically high alkaline cleaners formulated with various surfactants. They are used primarily on evaporator coils located indoors but can be used on condenser coils outdoors as well.

Several problems exist with the current liquid cleaners such as storage space and transportation requirements, spilling or leakage, and dilution errors.

The current demand for higher efficiency systems has caused air conditioning (A/C) units to become larger, thereby occupying significantly more space in the wholesaler's or the serviceman's warehouse. Liquid coil cleaners also occupy significant warehouse space. Liquid coil cleaners are purchased in case quantities (4 gallons per case) that take up a little more than one cubic foot per case and cases are bought in pallet quantities taking up 48 cubic feet of space or approximately a 3 ft×4 ft area. Liquid coil cleaners also take up significant storage space in a serviceman's truck, since about 8 gallons of cleaner or 2 cubic feet of truck space is required for one day of service calls.

It is not uncommon for a serviceman to accidentally puncture the liquid coil cleaner container in the truck and have highly corrosive liquids spill and damage the truck and tools. Wholesalers have similar problems with containers forming leaks when bottles are knocked off shelves or fork-lift trucks puncture cases of the liquid cleaner. Such spilled liquid cleaners can corrode floors, shelves and other merchandise.

Servicemen can also err in diluting concentrated cleaners. Without some type of additional measuring device it can be very difficult to accurately blend 2 or 3 parts water to one part cleaner and mix it in a pump-up sprayer. Servicemen habitually generate "diluted" cleaners that are either too dilute or too concentrated.

Furthermore, liquid cleaners, typically contain 70 to 80 wt. % water, which adds additional freight cost due to added weight and additional charges for transporting hazardous liquid formulations.

Prior attempts have been made by others to address some of these problems. A powdered cleaner, EV COIL MAX® is available from Highside Chemicals, Inc., Gulfport, Miss., USA. This product is reported to contain sodium metasilicate pentahydrate (a hazardous respirable dust with a 2 $mg/m^3$ recommended ceiling) and sodium lauryl sarcosine. While this product is prepackaged for 1 gallon dilution, the instructions suggest further dilution to up to 3 gallons. Hence, the mixing problem still exists. A second powdered cleaner, HL COIL BRITE™ is also available from Highside Chemicals, Inc., Gulfport, Miss., USA. This product is an acid based coil cleaner containing ammonium bifluoride (ABF; ammonium hydrogendifluoride) a hazardous respirable dust that can cause fluorosis, hypocalcemia and hypomagnesia. Another product, Instant Powder Kegs™, is available from Controlled Release Technologies, Inc., Clearwater, Fla., USA. This product contains sodium silicate and is combined with sodium hydroxide, a corrosive alkaline product.

SUMMARY OF THE INVENTION

Conventional cleaning compositions have several deficiencies, as explained above. The invention now provides a way to overcome these deficiencies, by providing a peroxide-based powdered cleaning composition that can be prepackaged and accurately formulated as an aqueous ready-to-use solution at the worksite.

Briefly, therefore, the present invention is directed to a powdered coil cleaner composition, the composition comprising about 50-90 wt % peroxide source, about 1-20 wt % surfactant, up to about 5 wt. % thickener, up to about 15 wt. % chelating agent, up to about 10 wt. % dust control agent; and up to about 30 wt. % dissolution enhancing agent.

The present invention is further directed to a container comprising a pre-measured amount of the powdered coil cleaner composition described above, wherein the amount of said composition in said container is sufficient to form an effective coil cleaner solution when mixed with about 0.5 to about 2 gallons of water.

The present invention is further directed to a method of cleaning a substrate, said method comprising mixing a pre-measured amount of the powdered coil cleaner composition described above into about 0.5 to about 2 gallons of water to create a solution; and applying said solution to said substrate.

DETAILED DESCRIPTION OF THE PREFERRED EMBODIMENTS

The present invention, therefore, provides powdered cleaners that are pre-measured for one time use and can be packaged in easy-tear pouches. The amount of dry powder required to make 8 gallons of a liquid cleaner (2 cubic ft) takes up 0.35 cubic ft, representing an 83 wt. % reduction in storage space for the powdered cleaner as compared to the liquid cleaner. If a bag tears open, the powdered cleaner can be swept up without damaging the surface where it was spilled since the powders are not corrosive. Also, these powdered cleaners are pre-measured so that one bag can be mixed with one gallon of water in a pump up sprayer to achieve the correct concentration. Moreover, the amount of powdered cleaner required to make one gallon of liquid cleaner weighs 1.5 lbs. This amounts to an 80 wt. % reduction in weight, which results in a tremendous savings in freight cost. Further, since the powder is packaged in single use packets, it is no longer classified as hazardous by the Department of Transportation (D.O.T.) and does not incur hazardous freight charges.

When the powdered cleaner is applied to a substrate, it need not be rinsed in order to remove grease, scale and other soils from the substrate. Further, itd will not damage the substrate or associated equipment.

The powdered cleaner composition of the invention comprises a peroxide source and a surfactant. The peroxide source can be any compound which liberates hydrogen peroxide in aqueous solution, such as inorganic bleaching agents and organic peroxides including alkali and alkaline earth perborate, percarbonate, perphosphate, monopersulfate and persilicate salts. In one embodiment, the peroxide source is selected from the group consisting of sodium percarbonate, lithium percarbonate, potassium percarbonate, sodium perborate, lithium perborate, potassium perborate, sodium perphosphate, potassium perphosphate, lithium perphosphate, sodium persilicate, potassium persilicate or lithium persilicate, sodium monopersulfate, lithium monopersulfate, potassium monopersulfate and urea hydrogen peroxide. In yet another embodiment, the peroxide source is sodium percarbonate, potassium percarbonate, lithium percarbonate, sodium perborate, potassium perborate or lithium perborate. The peroxide source used in the present invention is a solid at room temperature and should preferably have a melting point of at least 50° C. The amount of peroxide source in the composition of the invention will normally be in the range of from about 50-90 wt. %, preferably from about 70-85 wt. %, and more preferably about 77 wt. %. In some instances, the peroxide source has limited water solubility and a lower amount of peroxide source material is used in the composition, from about 50 wt. % to about 60 wt. %, and is supplemented with a dissolution-enhancing agent as described hereinafter.

The compositions of the invention further contain at least one surfactant, generally in an amount of from about 1 wt. % to about 20 wt. %, preferably from about 5 wt. % to about 15 wt. %. The surface-active agent can be anionic, nonionic, cationic amphoteric or zwitterionic or a mixture of such agents that are available as dry components can be incorporated into the cleaner formulation. The surfactants are chosen for their detergency and foaming ability. High foaming detergents are generally preferred; however, low foaming detergents could be used. Detergents that produce long lasting and durable foams are also preferred. While the primary goal is detergency and degreasing ability, dispersant characteristics are also desirable.

Suitable anionic surfactants to be used in compositions of the invention comprise linear alkyl benzene sulfonate, alkyl ester sulfonate surfactants, $C_8$-$C_{22}$ primary of secondary alkanesulfonates, $C_8$-$C_{24}$ olefinsulfonates, sulfonated polycarboxylic acids, $C_8$-$C_{24}$ alkylpolyglycolethersulfates (containing up to 10 moles of ethylene oxide); alkyl glycerol sulfonates, fatty acyl glycerol sulfonates, fatty oleyl glycerol sulfates, alkyl phenol ethylene oxide ether sulfates, paraffin sulfonates, alkyl phosphates, isothionates such as the acyl isothionates, N-acyl taurates, alkyl succinamates and sulfosuccinates, monoesters of sulfosuccinates (especially saturated and unsaturated $C_{12}$-$C_{18}$ monoesters) and diesters of sulfosuccinates (especially saturated and unsaturated $C_6$-$C_{12}$ diesters), acyl sarcosinates, sulfates of alkylpolysaccharides such as the sulfates of alkylpolyglucoside (the nonionic nonsulfated compounds being described below), branched primary alkyl sulfates, and alkyl polyethoxy carboxylates. Resin acids and hydrogenated resin acids are also suitable, such as rosin, hydrogenated rosin, and resin acids and hydrogenated resin acids present in or derived from tall oil. Other preferred anionic surfactants include alkyl alkoxylated sulfates such as $C_{12}$-$C_{18}$ alkyl polyethoxylate (1.0) sulfate, $C_{12}$-$C_{18}$ alkyl polyethoxylate (2.25) sulfate, $C_{12}$-$C_{18}$ alkyl polyethoxylate (3.0) sulfate, and $C_{12}$-$C_{18}$ alkyl polyethoxylate (4.0) sulfate.

Preferred anionic surfactants suitable for use in formulating the compositions of the invention include water-soluble salts of alkylbenzenesulfonates, alkyl sulfates, alkylpolyethoxyether sulfates, paraffin sulfonates, alpha-olefin sulfonates, alpha-sulfocarboxylates and their esters, alkylglycerylether sulfonates, fatty acid monoglyceride sulfates and sulfonates, alkylphenolpolyalkoxy ethersulfates, 2-acyloxyalkane-1-sulfonates and beta-alkyloxyalkane sulfonates. Preferred cleaning compositions comprise anionic surfactants or mixtures of anionic surfactants with other surfactants. Nonlimiting examples of surfactants useful herein include the conventional $C_{11}$-$C_{18}$ alkyl benzene sulfonates and primary, secondary and random alkyl sulfates, the $C_{10}$-$C_{18}$ alkyl alkoxy sulfates, the $C_{10}$-$C_{18}$ alkyl polyglycosides and their corresponding sulfated polyglycosides, $C_{12}$-$C_{18}$ alpha-sulfonated fatty acid esters, $C_{12}$-$C_{18}$ alkyl and alkyl phenol alkoxylates (especially ethoxylates and mixed ethoxy/propoxy), $C_{12}$-$C_{18}$ betaines and sulfobetaines ("sultaines"), $C_{10}$-$C_{18}$ amine oxides, and the like. Highly preferred anionic surfactants are alpha olefin sulfonates, sodium lauryl sulfate, dodecyl benzyl sulfonates, and alkylamides with about 8 to about 24 carbon atoms, more especially about 12 to about 16 carbon atoms.

Cationic surfactants suitable for use in the cleaning compositions of the present invention include secondary amines, tertiary amines, mono- or di-alkoxylated amines, quaternary ammonium salts, di- or mono-alkoxylated quaternary ammonium salts, and ether amines. Examples of suitable compounds include, but are not limited to: coconut trimethyl ammonium chloride or bromide, coconut methyl dihydroxyethyl ammonium chloride or bromide, decyl triethyl ammonium chloride, decyl dimethyl hydroxyethyl ammonium chloride or bromide, $C_{12-15}$ dimethyl hydroxyethyl ammonium chloride or bromide, coconut dimethyl hydroxyethyl ammonium chloride or bromide; myristyl trimethyl ammonium methyl sulphate; and lauryl dimethyl benzyl ammonium chloride or bromide. The preferred cationic surfactants suitable for use in the invention include quaternary ammonium compounds, e.g. alkyltrimethylammonium salts, dibenzylammonium salts and dialkyldimethyl ammonium salts, and fatty alkyl amines.

Nonionic surfactants suitable for use in the present invention include ethoxylated and/or propoxylated adducts of aliphatic $C_{12-18}$ alcohols, alkyl amine oxides, alkyl polyglucosides and alkyl methylsulfoxides.

Zwitterionic surfactants that can be used in the present invention include water-soluble derivatives of aliphatic quaternary ammonium, phosphonium and sulfonium cationic compounds in which the aliphatic moieties can be straight or branched, and wherein one of the aliphatic substituents contains from about 8 to 18 carbon atoms and one contains an anionic water-solubilizing group, especially alkyldimethylammonium propanesulfonates and carboxylates (betaines) and alkyldimethylammoniohydroxy propanesulfonates and carboxylates wherein the alkyl group in both types contains from about 8 to 18 carbon atoms.

Non limiting examples of the classes and species of surfactants useful in this invention are described in "McCutcheon's, Emulsifiers and Detergents", 1989 Annual, (M. C. Publishing Co.), and in "Surface Active Agents", vols. I & II, Schwartz, Perry & Berch, (Interscience). These listings and the foregoing recitation of specific surfactant compounds and mixtures can be used in formulating the composition of the present invention, as can salts, esters, or other derivatives of the surfactants described herein.

In one embodiment, the surfactant comprises anionic or nonionic surfactants such as, alkyl amido betaines (e.g., lauramidopropyl betaine), hydrocarbyl sulfonate salts (e.g. aryl sulfonates such as sodium naphthalene sulfonate and sodium dodecyl benzene sulfonate; alkyl sulfonates such as sodium lauryl sulfonate; alkenyl sulfonates such as alpha olefin sulfonate), optionally substituted hydrocarbyl carboxylate salts (e.g. alkyl carboxylates such as disodium lauryl iminodipropionate, disodium lauryl sulfosuccinate, sodium oleyl methyl taurate; substituted alkyl carboxylates such as sorbitan monostearate, glycerol monostearate; polyalkylene glycol carboxylates such as polyethyleneglycol monostearate, polyethyleneglycol distearate, sorbitan tristearate, sodium cocoylisethionate), polymeric alcohol ethoxylates (e.g. alkaryl alcohol ethoxylates such as alcohol ethoxylate (nonylphenyl) MW 4.3K, alcohol ethoxylate (nonylphenyl) MW 1450, alcohol ethoxylate (nonylphenyl) MW 2670), polyethylene glycol/polypropylene glycol (PEG/PPG) copolymers with molecular weight (MW) from about 4700 (4.7K) to about 14,600 (14.6K) and mixtures thereof (e.g., PEG/PPG copolymer MW 12.6K with PEG/PPG ratio of about 1:2, PEG/PPG copolymer MW 14.6 k with PEG/PPG ratio of about 1:3), PEG/PPG alkylenediamine (e.g., PEG/PPG oxylated ethylenediamine MW 18 K, PEG/PPG oxylated ethylenediamine MW 15 K) and alkylamides (e.g., fatty acid alkylamino alkylamides such as stearamidoethyl diethylamine and stearamidopropyl dimethylamine; polyalkylene glycol alkylamides such as PEG alkylamides and PPG alkylamides; hydrogenated fat alkylamides such as hydrogenated palm alkylamides and hydrogenated tallow alkylamides; and mixtures thereof). In yet another embodiment, the surfactant is selected from the group consisting of alpha olefin sulfonate, disodium lauryl sulfosuccinate, sodium naphthalene sulfonate, sodium oleyl methyl taurate, disodium lauryl iminodipropionate, PEG/PPG copolymers MW from about 4.7K to about 14.6K and mixtures thereof, alcohol ethoxylate (nonylphenyl) MW 4.3K, sodium naphthalene sulfonate, sodium lauryl sulfate, dodecyl benzyl sulfonate (DDBSA), sodium oleyl methyl taurate (Geropon T77) and lauramidopropyl betaine (Mackam 1200). In a preferred embodiment, the surfactant is an alpha olefin sulfonate, sodium lauryl sulfate, sodium dodecyl benzyl sulfonate or N-(2-hydroxyethyl) dodecanamide {Alkamide C-212}.

While none of the powder coil cleaners require a thickening agent for cleaning purposes, incorporation of a thickening agent can improve the overall quality of the product. Therefore, the compositions of the invention optionally further contain any thickener which increases the viscosity of the ultimate aqueous formulation and improves adhesion of the composition to the surface being cleaned. Nonlimiting examples of suitable thickeners include xanthan gum, polyacrylic thickeners, guar gum, polyvinyl alcohol and cellulosic thickeners. In another embodiment, the thickener is xanthan gum. The thickeners can be present in the powdered formulation in an amount up to about 5 wt. %. In one embodiment, the thickener is present in an amount of from about 1 to 4 wt. %. In another embodiment, the thickener is present in an amount of about 2 wt. %. Alternatively, utilization of some surfactants leads to very viscous solutions. In such instances, a thickening agent is neither necessary nor desirable and the formulation is devoid of thickener.

Other adjuvants which can be used in the compositions of the invention include chelating agents, dust control agents and dissolution enhancing agents. Chelating agents aid the cleaning process by dissolving metal ion corrosions/deposits on the substrate and also provide additional surfactant capacity. Typical chelating agents comprise salts of phosphonic acids, sulfonic acids, polycarboxylic acids, aminocarboxylic acids or hydroxocarboxylic acids. In one embodiment, the chelating agent comprises salts of nitrilotrismethylene phosphonic acid, sodium xylene sulfate, sulfamic acid, EDTA, citric acid, oxalic acid, glycolic acid or gluconic acid. Of these, the mild yet effective chelant, sodium gluconate, is preferred. This is used at a level of about 5 wt. % to about 15% by weight of the total composition; preferably about 10 wt. % of the total powder composition.

The dust control agent serves to minimize the release of dust particles from the powder into the environment to limit inhalation risk. Typical dust control agents include hydrolyzed sugars, ethylene glycol and propylene glycol; propylene glycol is preferred. These can be used at levels of about 0.1-4% by weight of the powder composition; preferably about 2 wt. % of the powder composition. Alternatively, the risk of exposure to dust particles form the cleaning agent is eliminated by use of a water soluble packaging material whereby the prepackaged unit is added directly to the predetermined amount of water without opening.

In some instances, the peroxide source has limited water solubility and a dissolution-enhancing agent is required to increase the level of useable peroxide source in solution. In one embodiment, the peroxide source with limited solubility is sodium perborate, wherein the amount of peroxide source is about 50-60 wt. % and is supplemented with about 20-30 wt. % of a dissolution-enhancing agent. Typically, amides and esters of carboxylic acids are effective dissolution-enhancing agents. In one embodiment, the dissolution-enhancing agent is tetraacetylethylenediamine (TAED).

In an embodiment of the invention, the peroxide source is sodium percarbonate, lithium percarbonate, or potassium percarbonate, the surfactant is selected from the group consisting of alpha olefin sulfonates, sodium lauryl sulfate, dodecyl benzyl sulfonate and alkylamides, and the thickener is selected from the group consisting of xanthan gum, polyacrylic thickeners, guar gum, and cellulosic thickeners.

In another embodiment, the peroxide source is sodium percarbonate, lithium percarbonate, or potassium percarbonate, the surfactant is selected from the group consisting of a powder or beaded alpha olefin sulfonate, sodium lauryl sulfate, dodecyl benzyl sulfonate, and alkylamides, and the thickener is selected from the group consisting of xanthan gum, polyacrylic thickeners, guar gum, and cellulosic thickeners. The composition of this embodiment further comprises from about 5 wt. % to about 15 wt. % of a chelating agent. In a further preferred embodiment, the chelating agent is sodium gluconate. In the more preferred embodiment, the composition additionally comprises a dust control agent such as from about 0.1 wt. % to about 4 wt. % propylene glycol. In an alternative embodiment, the composition is prepackaged in a water soluble material such as polyvinyl alcohol webbing for direct addition to water, so as to eliminate dust exposure.

In one embodiment of the present invention, powdered coil cleaner composition comprises from about 50 wt. % to about 90 wt. % sodium percarbonate; from about 5 wt. % to about 15 wt. % alpha olefin sulfonate; up to about 5 wt. % xanthan gum; up to about 10 wt. % sodium gluconate; up to about 2 wt. % propylene glycol and up to about 30 wt. % of tetraacetylethylenediamine (TAED). Other embodiments of the invention include the use of similar peroxide sources and surfactants, chelating agents, thickeners and dust control agents hereinbefore listed.

In a preferred embodiment of the invention, the powdered cleaning composition comprises about 77 wt. % sodium percarbonate; about 10 wt. % alpha olefin sulfonate; about 1 wt. % xanthan gum; and about 10 wt. % sodium gluconate.

In an embodiment of the present invention, powdered coil cleaner composition comprises from about 50 wt. % to about 60 wt. % sodium perborate; from about 5 wt. % to about 15 wt. % alpha olefin sulfonate; up to about 5 wt. % xanthan gum; up to about 10 wt. % sodium gluconate; up to about 2 wt % propylene glycol and from about 20 wt % to about 30 wt. % of tetraacetylethylenediamine (TAED). Other embodiments of the invention include the use of similar peroxide sources and surfactants, chelating agents, thickeners and dust control agents hereinbefore listed.

In a preferred embodiment of the invention, the powdered cleaning composition comprises about 53 wt. % sodium perborate; about 10 wt. % alpha olefin sulfonate; about 2 wt. % xanthan gum; about 10 wt. % sodium gluconate; and about 25 wt. % of tetraacetylethylenediamine (TAED).

Production of the powdered cleaning composition of the invention is accomplished by blending the components or by other means known in the art for powder formulations. For example, the composition can be made by top loading the dry raw materials into a ribbon mixer while blending. Propylene glycol is optionally added during blending to limit dust production. An auger based filling system is used to measure out the predetermined amounts of product, typically 4 oz. or 8 oz., into the packaging containers. The containers are then heat-sealed.

The invention is further directed to a method of cleaning a substrate, said method comprising; (a) mixing a pre-measured amount of a powdered coil cleaner composition into about 0.5 to about 2 gallons of water to create a solution; and (b) applying said solution to said substrate; wherein the powdered composition comprises from about 50 to about 90 wt. % of a peroxide source; from about 1 to about 20 wt. % of a surfactant; from about 0 to about 5 wt. % of a thickener; up to about 15 wt. % of a chelating agent; up to about 10 wt. % of a dust control agent; and up to about 30 wt. % of a dissolution enhancing agent.

In one embodiment, the invention is directed to a method of cleaning substrates, said method comprising mixing a pre-measured amount of a powdered coil cleaner composition comprising about 77 wt. % sodium percarbonate, about 10 wt. % alpha olefin sulfonate, up to about 5 wt. % xanthan gum into about 0.5 to 2 gallons of water to create a solution; and applying said solution to a substrate. In an embodiment of the method of cleaning substrates, the solution is applied by spraying. In another embodiment, the substrate is not rinsed with water after applying the solution to the substrate. The substrates comprise evaporator coils in general, air conditioning coils, condenser coils, electric air filters and other metal filters. In a preferred embodiment, the substrate is an evaporator coil in air conditioner units.

In a typical application to a substrate, such as an evaporator coil, a general purpose pump up sprayer such as Vapco Products' Spray Tower (part # STW-1) is filled with a volume of water. For optimal performance, warm or hot water can be used. The powdered evaporator cleaner is then poured directly into the sprayer. After securely replacing the cap, the entire sprayer is shaken so as to achieve dissolution of the powder product. The sprayer will develop positive pressure during this process; however, additional pressure should be added by pumping until the desired spray pressure is achieved. The cleaning solution is then sprayed onto the substrate. For an evaporator coil, the solution can be sprayed from the air intake side, preferably with the fan running. Once the coil has been fully saturated, the cooling unit can be turned on without rinsing. The peroxide or percarbonate in the cleaner will continue to destroy odors over time.

The current product and its method of use is distinguished from currently available hard surface cleaners in several respects. Unlike typical hard surface cleaners, no rinsing is required when used on substrates such as evaporator coils. In contrast to other evaporator coil cleaners, the product of the current invention is a solid mixed with water directly in a delivery system such as a pump up sprayer. Another distinguishing factor is that the current product uses percarbonate to generate some of the pressure required for product delivery. Further, the method of use of the peroxide-based product, wherein the solution is not rinsed off after application, leads to the destruction of odors initially and over an extended period of time. For cleaning applications, a single-use 8-oz package of the powdered composition of the invention is typically added to one gallon of water or a 4-oz package is added to a half gallon of water (1:1 dilution). However, if desired, two 8-oz packets of the powder can also be added to a one gallon of water (2:1 dilution) to yield a cleaning solution of greater strength, or one 8-oz packet of the powder can be added to two gallons of water (1:2 dilution) to yield a cleaning solution of weaker strength. Regarding the order of addition, it is preferred that the powder be added to the water in an appropriate container.

The invention is further directed to a container comprising a pre-measured amount of a powdered, coil cleaning composition as described above, wherein the amount of the composition in the container is sufficient to form an effective coil cleaner solution when mixed with about 0.5 to about 2 gallons of water. In an embodiment, the cleaning composition within the container comprises about 77 wt. % sodium percarbonate about 10 wt. % alpha olefin sulfonate; about 2 wt. % xanthan gum; about 10 wt. % sodium gluconate; and about 2 wt. % propylene glycol. In another embodiment, the cleaning composition within the container comprises from about 50 wt. % to about 60 wt. % sodium perborate, about 10 wt. % alpha olefin sulfonate, about 2 wt. % xanthan gum, about 10 wt. % sodium gluconate; about 2 wt. % propylene glycol; and from about 20 wt. % up to about 30 wt. % tetraacetylethylenediamine (TAED).

In another embodiment, the container comprises a packet or an envelope. The composition of the container typically comprises water soluble polyvinyl alcohol (PVA) webbing, polyethylene, polypropylene, paper, foil, or polyurethane or any combination of these materials. The size of the container is typically in the range of about 4 oz. to about 16 oz., preferably from about 4 oz. to about 12 oz., more preferably about 4 oz. or 8 oz. In one embodiment, the container is a composite envelope consisting of 25 lb Bleached Machine Grade Paper/7.2 lb Low Density Polyethylene/0.0003 mil Foil/14.4 lb Low Density Polyethylene (25 lb BL MG Paper/7.2 lb LDPE/0.0003 Foil/14.4 lb LDPE). In another embodiment, the container is a composite envelope consisting of 48 gauge Metallized Polyester/2.5 mil clear Linear Low Density Polyethylene (48 ga Metallized PET/2.5 mil cl LLDPE). In yet another embodiment, the container is a composite envelope consisting of form and fill packaging comprised wholly or in part of water-soluble polyvinyl alcohol webbing.

In another embodiment, the formulation incorporates powdered components and highly concentrated liquid components and the solid and liquid components are enclosed within separate compartments of a single multi-chambered packaging container. When the formulation includes powdered components and liquid components, the surfactants and/or thickeners can be present as solids or liquids. For example, an alkylpolyglucoside (Glucopon 625), alpha olefin sulfonate or any other highly concentrated surfactant previously stated above can be present in a liquid (first) compartment while the other dry components are present in a solid (second) compartment. Alternatively, a highly concentrated thickener solution such as a polyacrylate (Acusol 445) or xanthan gum can be present in the liquid compartment; and the other remaining components are present as dry solids in the solid compartment. Alternatively, the surfactant and thickener can be present as liquids in the first compartment; and the remaining components are present as dry solids in the second compartment. Additional surfactants and/or thickeners can also be included in the second compartment as desired.

The invention is further directed to a container comprising a solid component and a liquid component wherein the components collectively constitute a peroxide cleaning formulation. In an embodiment of the peroxide formulation described hereinabove, the liquid component comprises about 1-20 wt. % of a surfactant based on the weight of the total formulation and the solid component comprises up to about 5 wt. % of a thickener; about 50-90 wt. % of a peroxide source; up to about 15 wt. % of a chelating agent; up to about 10 wt. % of a dust control agent and up to about 30 wt. % of a dissolution enhancing agent based on the weight of the total formulation. In another embodiment, the liquid component comprises about 0.1-5 wt. % thickener based on the weight of the total formulation and the solid component comprises about 1-20 wt. % surfactant; about 50-90 wt. % a peroxide source; up to about 15 wt. % chelating agent; up to about 10 wt. % of a dust control agent and up to about 30 wt. % of a dissolution enhancing agent based on the weight of the total formulation. In yet another embodiment, the liquid component comprises about 1-20 wt. % surfactant and up to about 5 wt. % thickener based on the weight of the total formulation; and the solid component comprises about 50-90 wt. % a peroxide source; up to about 15 wt. % chelating agent; up to about 10 wt. % of a dust control agent and up to about 30 wt. % of a dissolution enhancing agent based on the weight of the total formulation. In the compositions hereinabove described, the peroxide source is selected from the group consisting of sodium percarbonate, potassium percarbonate, lithium percarbonate, sodium perborate, potassium perborate, lithium perborate, sodium perphosphate, potassium perphosphate, lithium perphosphate, sodium persilicate, potassium persilicate lithium persilicate, and mixtures thereof.

In one embodiment of a peroxide formulation described above, the liquid component comprises about 5-15 wt. % of alpha olefin sulfonate based on the weight of the total formulation; and the solid component comprises up to about 5 wt. % xanthan gum; about 50-90 wt. % of an alkali metal percarbonate or an alkali metal perborate; up to about 10 wt. % sodium gluconate; up to about 2 wt. % propylene glycol and up to about 30 wt. % tetraacetylethylenediamine (TAED) based on the weight of the total formulation. In another embodiment, the liquid component comprises about 0.1-5 wt. % xanthan gum based on the weight of the total formulation; and the solid component comprises about 5-15 wt. % alpha olefin sulfonate; about 50-90 wt. % of an alkali metal percarbonate or an alkali metal perborate; up to about 10 wt. % sodium gluconate; up to about 2 wt. % propylene glycol and up to about 30 wt. % TAED based on the weight of the total formulation. In yet another embodiment, the liquid component comprises about 2-5 wt. % alpha olefin sulfonate and about 1-5 wt. % xanthan gum based on the weight of the total formulation; and the solid component comprises about 50-90 wt. % of an alkali metal percarbonate or an alkali metal perborate; up to about 10 wt. % sodium gluconate; up to about 2 wt. % propylene glycol and up to about 30 wt. % TAED based on the weight of the total formulation.

EXAMPLES

The following examples, which are by no means limiting, will permit a better understanding of the invention and its advantages and certain variations of execution.

Example 1

A powder of the invention having the following composition has been studied with regard to cleaning capability and odor removal: 77 wt. % sodium percarbonate; 12 wt. % alpha olefin sulfonate; 2 wt. % xanthan gum; 10 wt. % sodium gluconate; and 2 wt. % propylene glycol.

In one test Crisco cooking grease was applied as a 2 mm film to galvanized sheet metal strips. One strip was immersed in a cleaning solution prepared by mixing 8 oz of the powder in one gallon of water. A second strip was immersed in a solution of Power Clean (Vapco Products) at four times the recommended concentration. Thirty minutes after immersion the strips were rinsed with cool water. The strip immersed in the cleaning solution of the invention was completely grease-free, while the Power Clean immersed strip still had trace grease residue remaining. No grease odor was detectable after cleaning with the cleaning solution of the invention.

In a second test, aluminum foil was rolled into a thin tube and a lit cigarette placed inside. Sufficient ventilation to maintain combustion of the cigarette was provided until no tobacco remained. The ashes were dumped and the foil unrolled to provide nicotine and tar covered aluminum samples. The samples were immersed in water (control) or the cleaning solution of the invention, as prepared above. After fifteen minutes the samples were removed and rinsed with cool water. The control sample showed no signs of cleaning and still smelled strongly of nicotine and smoke. The sample treated with the cleaning solution of the invention was completely free of both odor and nicotine/tar staining.

Example 2

Evaluation of Surfactants

The surfactants listed in Table 1 have been evaluated with regard to their suitability for incorporation into the powder coil cleaners of the current invention. The parameters evaluated were solubility, detergency, foam height, lipophilicity of nonionic surfactants (hydrophile-lipophile-balance, HLB number), and wetting. Wetting and detergency were based on cleaning of a metal strip which has been coated with cooking grease. The parameters were scored as follows:

Detergency (1=lowest, 5=highest); Solubility (1=lowest, 5=highest); Wetting (1=lowest, 5=highest); HLB (hydrophilicity; 1=least, 40=most); and Foam Height (Low, Medium High; relative, following agitation of the formulation for 15 seconds.). Additionally, combinations of these materials were also evaluated. In a typical analysis 0.3 grams of surfactant was dissolved in 50 ml of tap water. The results are summarized in Table 1.

Further, each surfactant with solubility equal to or greater than 3 was incorporated into a fully formulated product and tested as described in Example 1. These formulations were based on the optimal conditions set forth in the patent. The relative results from the formulations were identical to those presented in Table 1; for example, comparison of a fully formulated product containing Mackam 1200 and one containing Bioterge AS-90 provide the same relative solubilities, wetting, and detergency as those presented in Table 1.

TABLE 1

| Surfactant | Active Ingredient | Type | Detergency | Solubility | Foam | HLB | Wetting |
|---|---|---|---|---|---|---|---|
| Witconate AOK | alpha olefin sulfonate | Anionic | 4 | 5 | H | | 2 |
| Mackam 1200 | lauramidopropyl betaine | Nonionic | 5 | 5 | L | | 4 |
| Mackam LO-100 | Disodium lauryl sulfosuccinate | Anionic | 3 | 4 | M | | 1 |
| Petro 22-Powder | sodium naphthalene sulfonate | Anionic | 1 | 5 | M | | 2 |
| ACME-SLS | sodium lauryl sulfonate | Anionic | 5 | 1 | M | | 5 |
| Nacconol 90G | sodium dodecyl benzene sulfonate | Anionic | 5 | 2 | L | | 5 |
| Geropon T77 | sodium oleyl methyl taurate | Anionic | 1 | 3 | H | | 4 |
| Alkamide C-212 | N-(2-hydroxyethyl) dodecanamide | Nonionic | 5 | 1 | L | | 1 |
| Bioterge AS-90 | alpha olefin sulfonate | Anionic | 3 | 5 | H | | 3 |
| Deriphat 160 | Disodium Lauryl Iminodipropionate | Anionic | 1 | 5 | M | | 3 |
| S-Maz 65 k | Sorbitan tristearate | Nonionic | 1 | 1 | L | | 1 |
| S-Maz 60 k | Sorbitan monostearate | Nonionic | 1 | 1 | L | | 1 |
| Mazol GMS | glycerol Monostearate | Nonionic | 1 | 1 | L | | 1 |
| Mapeg 6000 DS | polyethyleneglycol distearate | Nonionic | 1 | 2 | L | | 1 |
| Mapeg S 40 K | polyethyleneglycol monostearate | Nonionic | 1 | 2 | L | | 1 |
| Pluronic F 88 | PEG/PPG Copolymer MW 11.4 K | Nonionic | 1 | 3 | L | >24 | 2 |
| Pluronic F 98 | PEG/PPG Copolymer MW 13 K | Nonionic | 1 | 3 | L | >24 | 2 |
| Pluronic F 38 | PEG/PPG Copolymer MW 4.7 K | Nonionic | 1 | 5 | L | >24 | 1 |
| Pluronic F 68 | PEG/PPG Copolymer MW 8.4 K | Nonionic | 1 | 3 | L | >24 | 1 |
| Pluronic F 77 | PEG/PPG Copolymer MW 6.6 K | Nonionic | 1 | 4 | L | >24 | 1 |
| Pluronic F 87 | PEG/PPG Copolymer MW 7.7 K | Nonionic | 1 | 4 | L | >24 | 1 |
| Pluronic F 127 | PEG/PPG Copolymer MW 12.6 K 1:2 | Nonionic | 1 | 3 | L | 18-23 | 1 |
| Pluronic F108 | PEG/PPG Copolymer MW 14.6 k 1:3 | Nonionic | 2 | 1 | L | >24 | 2 |
| Lutensol NP100 | alcohol ethoxylate (nonylphenyl) MW 4.3 K | Nonionic | 1 | 3 | L | >20 | 2 |
| Lutensol AT 25 | alcohol ethoxylate (nonylphenyl) MW 1450 | Nonionic | 1 | 1 | L | 20 | 3 |
| Lutensol AT 55 | alcohol ethoxylate (nonylphenyl) MW 2670 | Nonionic | 1 | 1 | L | 24 | 2 |
| Jordapon CI | sodium cocoylisethionate | Anionic | 4 | 2 | H | | 4 |
| Tetronic 1307 | PEG/PPG oxylated ethylendiamine MW 18 K | Nonionic | 1 | 1 | L | >24 | 2 |
| Tetronic 1107 | PEG/PPG oxylated ethylendiamine MW 15 K | Nonionic | 1 | 1 | L | 18-23 | 1 |
| Naxan | sodium naphthalene sulfonate | Anionic | 2 | 5 | L | | 2 |
| | Detergency 1 = Lowest 5 = Best<br>Solubility 1 = Lowest 5 = Highest<br>Foam Height: Low Medium High<br>Wetting 1 = Lowest 5 = Best | | Wetting and Detergency based on cleaning of metal strip coated with cooking grease | | | | |

All of the materials listed in Table 1 could be used in mixtures or as the sole surfactant in the formulations. For formulations comprising Mackam 1200 or other non-ionic surfactants which may have excellent results if not for low foam, a small amount of anionic or cationic surfactant may be added for improved foaming without loss of performance.

The formulation containing Mackam 1200 results in a very viscous solution in cases of high alkalinity. Therefore, in this example, a thickening agent such as xantham gum is not necessary or desirable.

Sodium perborate exhibited lower solubility and required higher temperatures for full activation. Hence, addition of TAED (tetraacetylethylenediamine) was required to for activation. While not required for a percarbonate system, concentrations of TAED up to 30 wt. % may improve performance. For perborate based systems TAED should be added preferably at the 20-30 wt. % level with the perborate at 60-50 wt. %.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above methods and compositions without departing from the scope of the invention, it is intended that all matter contained in the above description shall be interpreted as illustrative and not in a limiting sense.

The invention claimed is:

1. A method of cleaning a coil or filter substrate selected from the group consisting of an evaporator coil, an air conditioning coil, or an electric air filter, said method comprising (a) mixing a pre-measured amount of a powdered coil or filter cleaner composition into about 0.5 to about 2 gallons of water to create a solution; and (b) applying said solution to said substrate; wherein the powdered composition comprises:

from about 50 to about 90 wt. % of a peroxide source;

from about 1 to about 20 wt. % of a surfactant;

from about 0 to about 5 wt. % of a thickener;
up to about 15 wt. % of a chelating agent;
up to about 10 wt. % of a dust control agent; and
up to about 30 wt. % of a dissolution enhancing agent.

2. The method of claim 1 wherein the substrate is an evaporator coil.

3. The method of claim 1 wherein the solution is not rinsed off the substrate after the solution is applied to the substrate.

4. The method of claim 1 wherein the peroxide source is selected from the group consisting of an alkali or an alkaline earth salt of a perborate, percarbonate, perphosphate, monopersulfate or persilicate, or urea hydrogen peroxide.

5. The method of claim 1 wherein the surfactant comprises anionic or nonionic surfactants.

6. The method of claim 5 wherein the surfactant is selected from the group consisting of an alkyl amido betaine, aryl sulfonate, alkyl sulfonate, alkenyl sulfonate, alkyl carboxylate, substituted alkyl carboxylate, polyalkylene glycol carboxylate, sorbitan tristearate, sodium cocoylisethionate, polymeric alcohol ethoxylate, polyethylene glycol/polypropylene glycol (PEG/PPG) copolymer, PEG/PPG alkylenediamine, fatty acid alkylamino alkylamide, polyalkylene glycol alkylamide, hydrogenated fat alkylamide or mixtures thereof.

7. The method of claim 1 wherein the powdered composition contains about 0.1-4 wt. % of a thickener.

8. The method of claim 7 wherein the thickener comprises xanthan gum, a polyacrylic thickener, guar gum or a cellulosic thickener.

9. The method of claim 1 wherein the powdered composition contains about 5 to about 15 wt. % of a chelating agent.

10. The method of claim 9 wherein the chelating agent is selected from the group consisting of a salt of phosphonic acid, sulfonic acid, polycarboxylic acid, aminocarboxylic acid or hydroxycarboxylic acid.

11. The method of claim 1 wherein the powdered composition comprises from about 0.1 wt. % to about 4 wt. % of a dust control agent.

12. The method of claim 11 wherein the dust control agent comprises a hydrolyzed sugar, ethylene glycol or propylene glycol.

13. The method of claim 1 wherein the powdered composition comprises about 0.1-30 wt. % of a dissolution enhancing agent.

14. The method of claim 13 wherein the dissolution enhancing agent comprises amides or esters of carboxylic acids.

15. The method of claim 1 wherein the powdered composition comprises
from about 50 wt. % to about 90 wt. % of an alkali metal percarbonate or perborate;
from about 5 wt. % to about 15 wt. % alpha olefin sulfonate;
up to about 5 wt. % xanthan gum;
up to about 10 wt. % sodium gluconate;
up to about 2 wt. % propylene glycol; and
up to about 30 wt. % tetraacetylethylenediamine (TAED).

16. The method of claim 15 wherein the alkali metal is sodium, lithium or potassium.

17. The method of claim 1 wherein the powdered composition and the water are mixed in a pump up sprayer to create the solution; and said solution is applied by spraying.

* * * * *